US011053726B2

(12) United States Patent
Hohwart

(10) Patent No.: US 11,053,726 B2
(45) Date of Patent: Jul. 6, 2021

(54) ACTUATABLE SLIDING PANEL ASSEMBLY; RETROFIT KIT AND METHOD FOR RETROFITTING A SLIDING PANEL FOR MECHANICALLY ASSISTED MOVEMENT BETWEEN OPEN AND CLOSED POSITIONS

(71) Applicant: Todd A. Hohwart, Saginaw, MI (US)

(72) Inventor: Todd A. Hohwart, Saginaw, MI (US)

( * ) Notice: Subject to any disclaimer, the term of this patent is extended or adjusted under 35 U.S.C. 154(b) by 0 days.

(21) Appl. No.: 16/894,553

(22) Filed: Jun. 5, 2020

(65) Prior Publication Data

US 2020/0300024 A1 Sep. 24, 2020

Related U.S. Application Data

(62) Division of application No. 15/625,823, filed on Jun. 16, 2017, now Pat. No. 10,676,978.

(51) Int. Cl.

| | |
|---|---|
| ***E05F 15/635*** | (2015.01) |
| ***E05F 15/641*** | (2015.01) |
| ***E05F 15/06*** | (2006.01) |
| *E05D 15/06* | (2006.01) |

(52) U.S. Cl.

CPC ..... *E05F 15/635* (2015.01); *E05F 15/641* (2015.01); *E05D 15/0665* (2013.01); *E05D 15/0686* (2013.01); *E05D 15/0691* (2013.01); *E05Y 2900/132* (2013.01); *E05Y 2900/148* (2013.01)

(58) Field of Classification Search

CPC ..... E05F 15/635; E06B 11/045; E06B 11/53
USPC ..... 49/63, 139, 140, 360, 362; 74/422
See application file for complete search history.

(56) References Cited

U.S. PATENT DOCUMENTS

| | | | | |
|---|---|---|---|---|
| 515,672 A ‡ | 2/1894 | Goode et al. | ..... | B61D 19/002 49/143 |
| 1,411,039 A * | 3/1922 | Lacey | ..... | E05F 15/652 49/118 |
| 1,509,707 A * | 9/1924 | Burkett | ..... | E05F 11/42 16/195 |
| 1,731,908 A ‡ | 10/1929 | Regalmuto | ..... | B61L 29/224 246/12 |
| 1,757,751 A * | 5/1930 | Strauss | ..... | E05F 15/665 49/361 |

(Continued)

FOREIGN PATENT DOCUMENTS

| | | | | |
|---|---|---|---|---|
| BE | 849567 A ‡ | 1/1977 | | |
| CA | 2713608 A1 ‡ | 1/2012 | ..... | E05F 15/635 |

(Continued)

*Primary Examiner* — Robert Canfield
(74) *Attorney, Agent, or Firm* — John D. Wright; Dickinson Wright PLLC

(57) ABSTRACT

An actuatable slidable panel assembly, a retrofit kit for converting a slidable panel of a panel assembly from manually actuated sliding movement to mechanically assisted, actuatable sliding movement, and method of retrofitting a manually operating sliding panel therewith are provided. The retrofit kit includes an elongate driven rail configured for attachment to the slidable panel. The elongate driven rail is configured to be attached to the slidable panel. A rotatable drive member is configured for operable engagement with the elongate driven rail to drive the elongate driven rail and the slidable panel along the direction of travel between open and closed positions.

11 Claims, 7 Drawing Sheets

(56) References Cited

U.S. PATENT DOCUMENTS 1,850,091 A ‡ 3/1932 Bailey ..... E05F 11/54 49/362
1,862,932 A ‡ 6/1932 Home ..... B61D 19/005 49/362
2,598,709 A * 6/1952 Morris ..... E05F 15/686 74/89.14
2,621,543 A * 12/1952 Rossmann ..... E05F 15/692 74/625
2,621,544 A * 12/1952 Rossmann ..... E05F 15/692 475/4
2,766,492 A ‡ 10/1956 Day ..... E05F 11/42 49/119
3,152,368 A ‡ 10/1964 Whitfield ..... E05F 11/53 49/342
3,237,250 A ‡ 3/1966 Scoville ..... E06B 3/4609 49/136
3,241,283 A ‡ 3/1966 Ahlgren ..... E06B 3/4609 49/425
3,384,998 A ‡ 5/1968 Abramson ..... E05D 15/0626 49/411
3,837,119 A ‡ 9/1974 Conneally ..... E05F 1/16 49/404
3,956,854 A * 5/1976 Yamamoto ..... E05D 15/0665 49/425
4,092,575 A ‡ 5/1978 Ogishi ..... E05F 15/40 318/282
4,257,192 A * 3/1981 Bartholomew ..... E05F 11/405 49/140
4,333,272 A ‡ 6/1982 Eastman ..... E06B 3/4609 49/505
4,334,161 A * 6/1982 Carli ..... H02K 11/23 200/80 R
4,366,649 A ‡ 1/1983 Weigant ..... E05F 15/635 49/362
4,541,202 A ‡ 9/1985 Dockery ..... E05F 15/635 49/362
4,553,656 A * 11/1985 Lense ..... E05F 11/24 192/142 R
4,611,436 A ‡ 9/1986 Williams ..... A47K 3/34 4/557
4,669,222 A ‡ 6/1987 Ujihara ..... B60J 1/17 49/349
4,893,435 A ‡ 1/1990 Shalit ..... E05F 15/643 49/139
4,945,678 A * 8/1990 Berner ..... E05F 11/505 192/150
5,006,766 A * 4/1991 Yuhas ..... E05F 15/619 318/53
5,040,331 A * 8/1991 Merendino ..... E05F 15/78 49/25
5,261,187 A ‡ 11/1993 Prenger ..... E05F 15/635 49/362
5,313,737 A * 5/1994 Midas ..... E05F 15/63 49/139
5,351,441 A ‡ 10/1994 Hormann ..... E05B 11/045 49/362
5,493,813 A * 2/1996 Vetter ..... E05F 11/24 475/339
5,515,650 A ‡ 5/1996 Machill ..... E06B 11/045 49/362
5,680,729 A ‡ 10/1997 Heffington ..... E05F 15/53 49/362
6,041,551 A ‡ 3/2000 Aspenwall ..... E05D 11/0018 49/425
8,182,052 B2 ‡ 5/2012 Bourgain ..... E05B 47/026 312/139.2
8,474,186 B2 ‡ 7/2013 Dufour ..... B60J 1/1853 49/380
8,544,215 B2 ‡ 10/2013 Gazda ..... E05D 15/0656 52/64
8,595,977 B2 ‡ 12/2013 Hancock ..... E05F 15/635 49/349
8,931,216 B2 ‡ 1/2015 Gazda ..... E05D 15/0656 52/64
D841,836 S ‡ 2/2019 Hohwart ..... E05F 15/635 D25/119
2008/0163553 A1 ‡ 7/2008 Liao ..... E05F 15/689 49/362
2008/0229667 A1 ‡ 9/2008 Dufour ..... B60J 1/1853 49/349
2009/0038228 A1 ‡ 2/2009 Lee ..... E05D 15/1042 49/360
2019/0003235 A1 ‡ 1/2019 Hall ..... E05F 15/77

FOREIGN PATENT DOCUMENTS

DE 3344390 A1 ‡ 6/1985 ..... E05F 15/635
DE 9305395 U1 ‡ 8/1994 ..... E06B 11/045
DE 19753219 A1 * 9/1998 ..... E06B 3/4609
DE 102007041360 A1 ‡ 6/2008 ..... E05D 15/0652
EP 0631031 A2 ‡ 12/1994
EP 3239447 A1 ‡ 11/2017
FR 2664644 A1 * 1/1992 ..... E05F 15/635
GB 183554 A ‡ 7/1922 ..... E05F 11/42
GB 500251 A ‡ 2/1939
JP 06173528 A ‡ 6/1994

* cited by examiner
‡ imported from a related application

ACTUATABLE SLIDING PANEL ASSEMBLY; RETROFIT KIT AND METHOD FOR RETROFITTING A SLIDING PANEL FOR MECHANICALLY ASSISTED MOVEMENT BETWEEN OPEN AND CLOSED POSITIONS

CROSS REFERENCE TO RELATED APPLICATION

This divisional application claims priority to U.S. application Ser. No. 15/625,823, filed Jun. 16, 2017, which is incorporated herein by reference in its entirety.

BACKGROUND OF THE INVENTION

1. Technical Field

This invention relates generally to slidable panels that translate between open and closed positions to open and close an opening, and more particularly to slidable panels including a device to facilitate sliding movement between open and closed states, and to devices that facilitate movement of a slidable panel between open and closed states.

2. Related Art

Slidable panels, including windows and doors, are commonly used to close and open an opening. Typically, the slidable panel has a graspable member, such as a knob or recessed slot, which a user can grasp to manually open and close the panel. Although manual operation of such slidable panels is generally effective to open and close the panel, it commonly comes with drawbacks.

One well known slidable panel that is manually operated routinely throughout the course of a day can be found at a reception area of most any business. One such business includes a doctor office, for example. A receptionist in a doctor's office typically opens and closes a slidable window (panel) countless times per day. Manual operation of the window is typically performed by grasping a slightly recessed notch formed in a window pane with finger tips, and then with a sweeping motion of the receptionist's arm and shoulder, the receptionist slides the window between open and closed states, as necessary to speak with the patient and then again to close the reception opening. It is not only necessary to slide the window to an open state to allow interaction between the receptionist and the patient, but it is equally important to return the window to a closed state to protect confidential patient information residing on a receptionist's side of the window against unwanted public disclosure. Conversations concerning a patient's medical condition typically occur on the receptionist side of the window, wherein the conversation must be maintained confidential and protected from persons on a patient side of the window in order to comply with HIPAA (Health Insurance Portability and Accountability Act) laws. Accordingly, the receptionist or medical staff must close the window to avoid unwanted disclosure of a patient's confidential medical information. If the window is not returned to a closed state, the improper audible disclosure of a patient's confidential medical information is at risk, as well as the improper taking of sensitive patient documents.

Unfortunately, although necessary to avoid a potential violation of HIPAA laws, repeated manual operation of the window over the course of a day generally becomes tiresome, both mentally and physically. Physical fatigue can result in repetitive motion type injuries, which are among the most common injuries in the United States. Some of the most common types of repetitive motion injuries are tendinitis and bursitis, wherein both can occur to a receptionist, such as in the receptionist's fingers, elbows, shoulders, and back region, as a result of repeatedly opening and closing a reception window. Further complicating matters, wear caused to components that slide, roll or translate relative to one another typically cause the person opening and closing the window to use an increasingly greater force to perform the sliding movement of the window. Such components subject to wear include rollers fixed within a window frame member, sometimes referred to as "shoe", wherein the rollers are configured to roll along a guide track, sometime referred to as "shoe rail". The wear to the rollers is unavoidable given they typically support the full weight of the window under a gravitational force. Accordingly, over time, movement of the window becomes complicated, thereby causing an increased potential for mental and physical fatigue to a receptionist.

Solutions in accordance with the present invention overcome or greatly minimize the issues described above.

SUMMARY OF THE INVENTION

One aspect of the invention provides a retrofit kit for converting a slidable panel of a panel assembly from manually actuated sliding movement to mechanically assisted, actuatable sliding movement, wherein the retrofit kit ensures the installer has all the correct components for converting the manually actuated panel to a mechanically assisted sliding panel. The retrofit kit includes an elongate driven rail configured for attachment to the slidable panel. The elongate driven rail extends along a longitudinal axis between opposite ends, with the longitudinal axis extending substantially parallel to a direction of travel of the slidable panel upon being attached to the slidable panel. A rotatable drive member is configured for operable engagement with the elongate driven rail to drive the elongate driven rail and the slidable panel along the direction of travel between open and closed positions.

In accordance with another aspect of the invention, the retrofit kit can further include providing the elongate driven rail with a fixation channel extending generally parallel to the longitudinal axis, with the fixation channel being configured to receive a free edge of the slidable panel therein to fix the elongate driven rail to the slidable panel.

In accordance with another aspect of the invention, the retrofit kit can further include providing the elongate driven rail with a plurality of driven teeth and providing the rotatable drive member with a plurality of drive teeth, with the drive teeth being configured for meshed, driving engagement with the driven teeth.

In accordance with another aspect of the invention, the retrofit kit can further include providing the elongate driven rail having an H-shaped region as viewed in cross-section, with the fixation channel being formed on one side of the H-shaped region and a slide channel being formed on an opposite side of the H-shaped region, with the slide channel being configured to facilitate sliding movement of the slidable panel along the direction of travel.

In accordance with another aspect of the invention, the retrofit kit can further include providing a plurality of rollers fixed in the slide channel, with the rollers being configured to roll along a guide rail of the panel assembly.

In accordance with another aspect of the invention, the retrofit kit can further include providing the elongate driven rail extending laterally outwardly in oblique relation relative to an upstanding leg of the H-shaped region.

In accordance with another aspect of the invention, the retrofit kit can further include providing a motor operably attached to the rotatable drive member, with the motor being selectively actuatable to rotate the rotatable drive member in opposite directions to drive the slidable panel along the direction of travel between open and closed positions.

In accordance with another aspect of the invention, the retrofit kit can further include providing a slip-clutch between the motor and the rotatable drive member, with the slip-clutch being adjustable to regulate the torque transmitted between the rotatable drive member and the driven rail.

In accordance with another aspect of the invention, the retrofit kit can further include providing at least one switch configured to interrupt power to the motor.

In accordance with another aspect of the invention, the retrofit kit can further include providing the elongate driven rail being generally L-shaped, having a first leg configured for operable attachment to the slidable panel and a second leg providing a driven surface configured for engagement with the rotatable drive member.

In accordance with another aspect of the invention, the retrofit kit can be provided to automate movement of a slidable panel of a reception desk window.

In accordance with another aspect of the invention, an actuatable slidable panel assembly is provided. The assembly includes a guide track, a panel slidable along the guide track between open and closed positions, an elongate driven rail attached to the panel, with the elongate driven rail extending along a longitudinal axis between opposite ends, and with the longitudinal axis extending substantially parallel to a direction of travel of the panel. Further, a rotatable drive member is configured for operable engagement with the elongate driven rail to drive the panel along the guide track between open and closed positions.

In accordance with another aspect of the invention, the elongate driven rail of the assembly can have a fixation channel extending along the longitudinal axis, with the panel having a free edge fixed in the fixation channel.

In accordance with another aspect of the invention, the elongate driven rail of the assembly can have a plurality of driven teeth and the rotatable drive member can have a plurality of drive teeth, with the drive teeth being configured in meshed, driving engagement with the driven teeth.

In accordance with another aspect of the invention, the elongate driven rail of the assembly can have an H-shaped region as viewed in cross-section, with the fixation channel being on one side of the H-shaped region and a slide channel being on an opposite side of the H-shaped region, with the slide channel facilitating sliding movement of the panel along the direction of travel.

In accordance with another aspect of the invention, the assembly can include a plurality of rollers fixed in the slide channel, with the rollers being configured to roll along an upstanding rail of the guide track.

In accordance with another aspect of the invention, the elongate driven rail of the assembly can extend laterally outwardly in oblique relation from an upstanding leg of the H-shaped region, with the elongate driven rail and the H-shaped region being formed as a monolithic, extruded piece of material.

In accordance with another aspect of the invention, the assembly can include a motor operably attached to the rotatable drive member, with the motor being selectively actuatable to rotate the rotatable drive member in opposite directions.

In accordance with another aspect of the invention, the assembly can include a slip-clutch between the motor and the rotatable drive member, with the slip-clutch being adjustable to regulate the torque transmitted between the rotational drive member and the driven rail.

In accordance with another aspect of the invention, the assembly can include at least one proximity switch configured to selectively interrupt power to the motor.

In accordance with another aspect of the invention, the elongate driven rail of the assembly can be generally L-shaped, having a first leg attached to the panel and a second leg having a driven surface configured for engagement with the rotatable drive member.

In accordance with another aspect of the invention, a method of retrofitting a panel of a panel assembly having a manually actuated sliding movement to mechanically assisted, actuatable sliding movement is provided. The method of retrofitting includes, fixing an elongate driven rail to the slidable panel with the elongate driven rail extending substantially parallel to a direction of travel of the slidable panel, and fixing a rotatable drive member in operable engagement with the elongate driven rail. Further, operably coupling a motor to the rotatable drive member and configuring the motor for selective actuation to rotate the rotatable drive member in opposite directions to drive the panel between open and closed positions.

In accordance with another aspect of the invention, the method of retrofitting can further include providing the elongate driven rail with a plurality of driven teeth and providing the rotatable drive member with a plurality of drive teeth and arranging the drive teeth in meshed, driving engagement with the driven teeth.

In accordance with another aspect of the invention, the method of retrofitting can further include removing an existing panel support member, also referred to as "shoe", from the manually actuated panel assembly and providing the elongate driven rail having an H-shaped region as viewed in cross-section, with a fixation channel being formed on one side of the H-shaped region and a slide channel being formed on an opposite side of the H-shaped region, and fixing a free edge of the slidable panel in the fixation channel and arranging the slide channel for sliding movement along a guide track of the slidable panel.

In accordance with another aspect of the invention, the method of retrofitting can further include providing a plurality of rollers fixed in the slide channel and arranging the plurality of rollers to roll along a guide rail of the guide track.

In accordance with another aspect of the invention, the method of retrofitting can further include providing a slip-clutch between the motor and the rotatable drive member, with the slip-clutch being adjustable to regulate the torque transmitted between the rotatable drive member and the driven rail.

In accordance with another aspect of the invention, the method of retrofitting can further include providing the elongate driven rail having first and second legs being generally L-shaped as viewed in cross-section, and attaching the first leg to the slidable panel and arranging a driven surface of the second leg in engagement with the rotatable drive member.

In accordance with another aspect of the invention, an extruded panel support member ("shoe") having a driven rail extending laterally outwardly therefrom to facilitate mechanically assisted driving movement of a panel fixed to the panel support member is provided.

BRIEF DESCRIPTION OF THE DRAWINGS

These and other objects, features and advantages will become readily apparent to those skilled in the art in view of the following detailed description of presently preferred embodiments and best mode, appended claims, and accompanying drawings, in which:

DETAILED DESCRIPTION OF PREFERRED EMBODIMENTS

Figure 1:
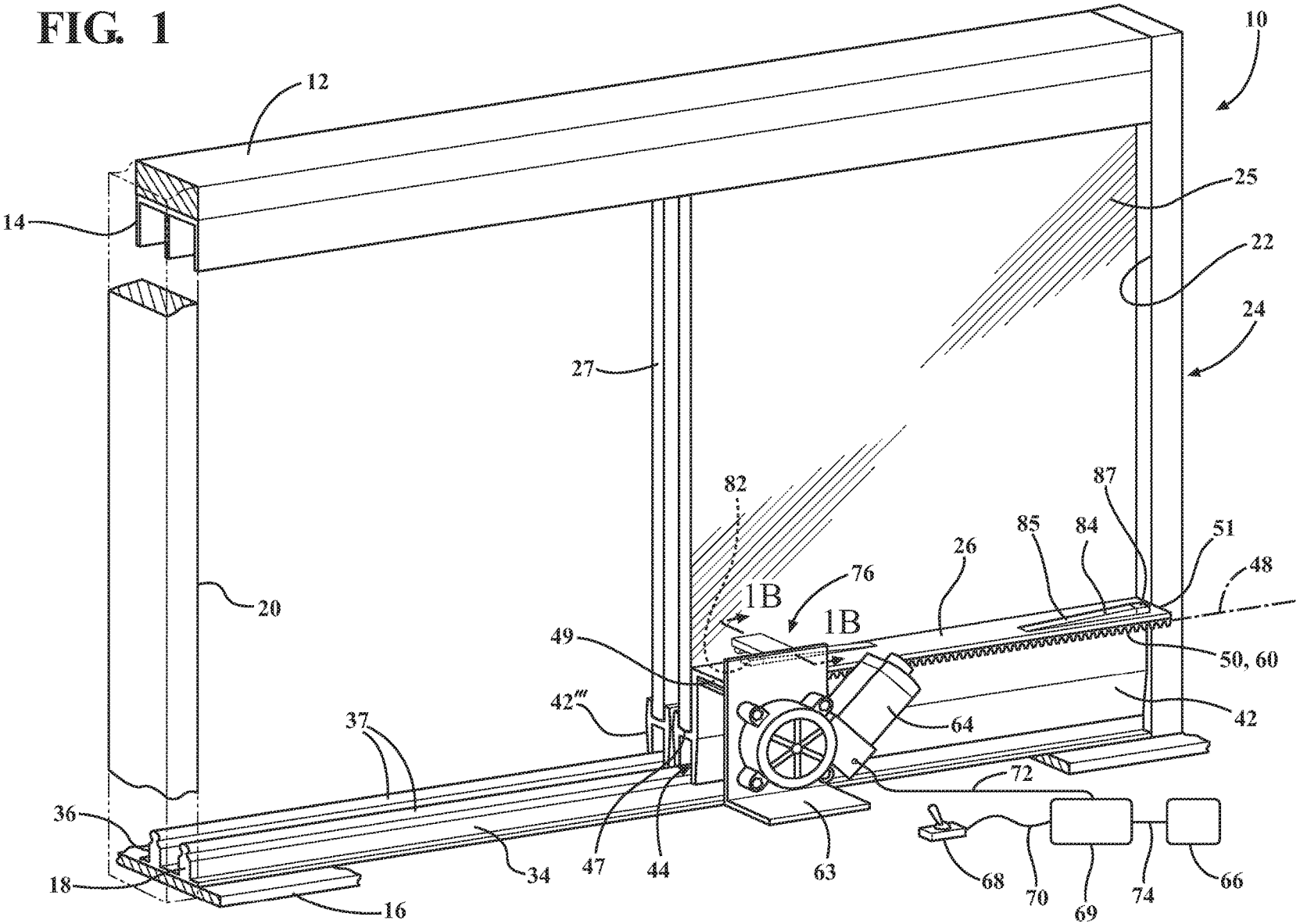
FIG. 1 is a perspective view of an actuatable slidable panel assembly in accordance with one aspect of the invention.

Referring in more detail to the drawings, FIG. 1 shows an actuatable slidable panel assembly in accordance with one aspect of the invention, referred to hereafter simply as assembly 10. The assembly 10 is represented as a slidable window assembly, such as the kind of commonly found in a reception area of a business, such as a doctor's office, by way of example and without limitation. The assembly 10 has a peripheral frame structure, including an upper jamb 12 having an upper guide track 14, a lower sill 16 extending generally parallel with the upper jamb 12, with the lower sill 16 having a lower guide track 18, and laterally spaced side jambs 20, 22 extending parallel to one another between the upper jamb 12 and lower sill 16. A panel assembly 24, such as a window assembly, by way of example and without limitation, is disposed within an opening bounded by the upper jam 12, lower sill 16 and side jambs 20, 22. The panel assembly 24 includes a slidable panel 25 that is slidable along the upper and lower guide tracks 14, 18 between open and closed positions. The panel assembly 24 can also include one or more additional panels 27, such as a fixed panel, by way of example and without limitation, though it too can be configured to translate along the upper and lower guide tracks 14, 18. An elongate driven rail 26 is operably attached to the slidable panel 25, and a rotatable drive member 28 (FIG. 1B) is configured for operable engagement with the elongate driven rail 26 to selectively drive the slidable panel 25 in sliding motion along the guide tracks 14, 18 between open and closed positions. While the panel 25 is in the open position, a person, such as patient, on one side of the assembly 10, referred to hereafter as customer or patient side 30, can freely converse with a person, such as a receptionist or medical personnel, on an opposite side of the assembly 10, referred to hereafter as receptionist side 32, by way of example and without limitation. On the contrary, while the panel 25 is in the closed position, communication conducted on the receptionist side 32 of the assembly 10 is maintained in confidence from persons on the patient side 30 of the assembly 10, such that the communications cannot be heard nor sensitive documents taken. Accordingly, unintentional violation of HIPAA laws is prevented.

Figure 1A:
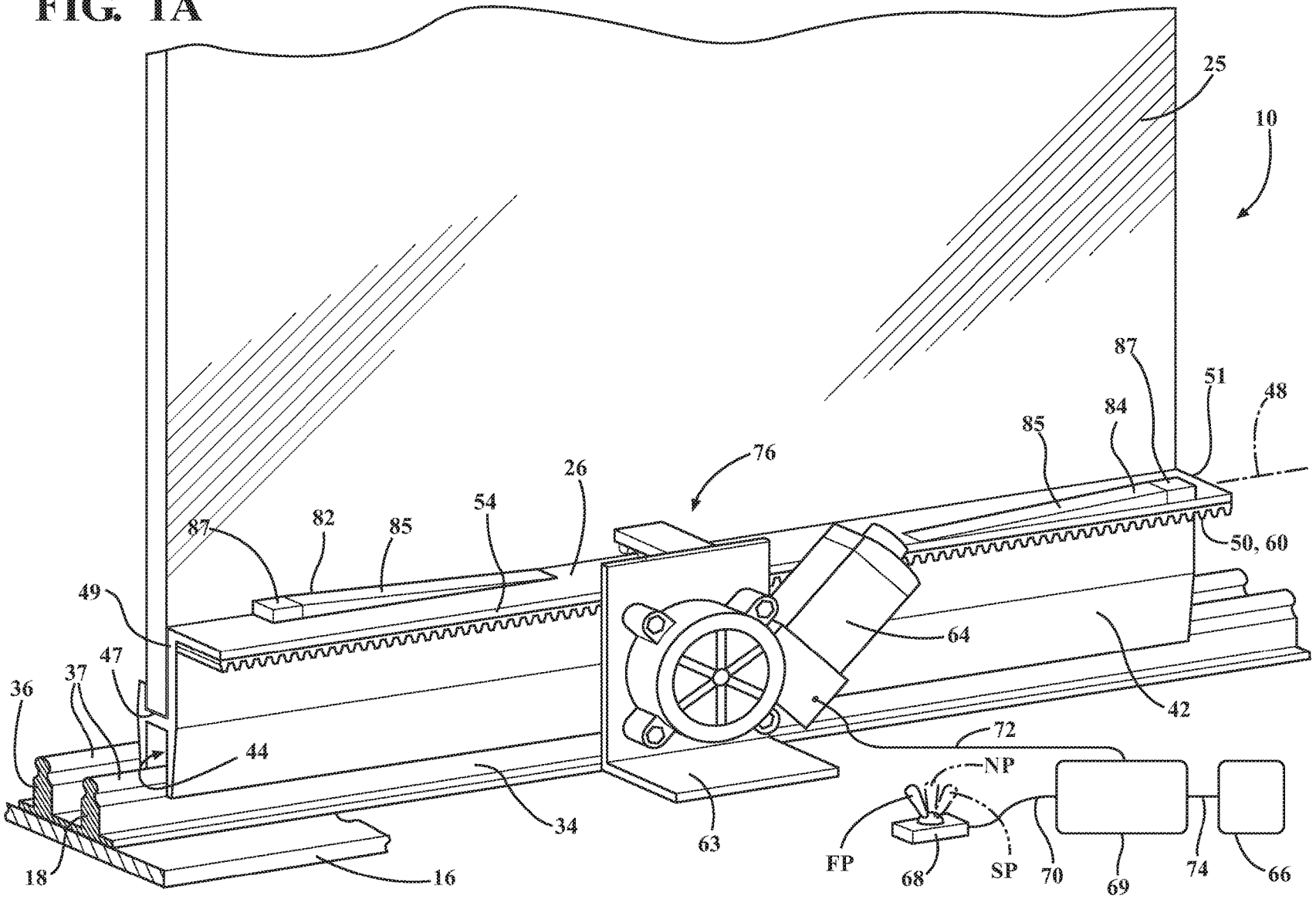
FIG. 1A is an enlarged fragmentary view of a lower region of the assembly of FIG. 1.
Figure 1B:
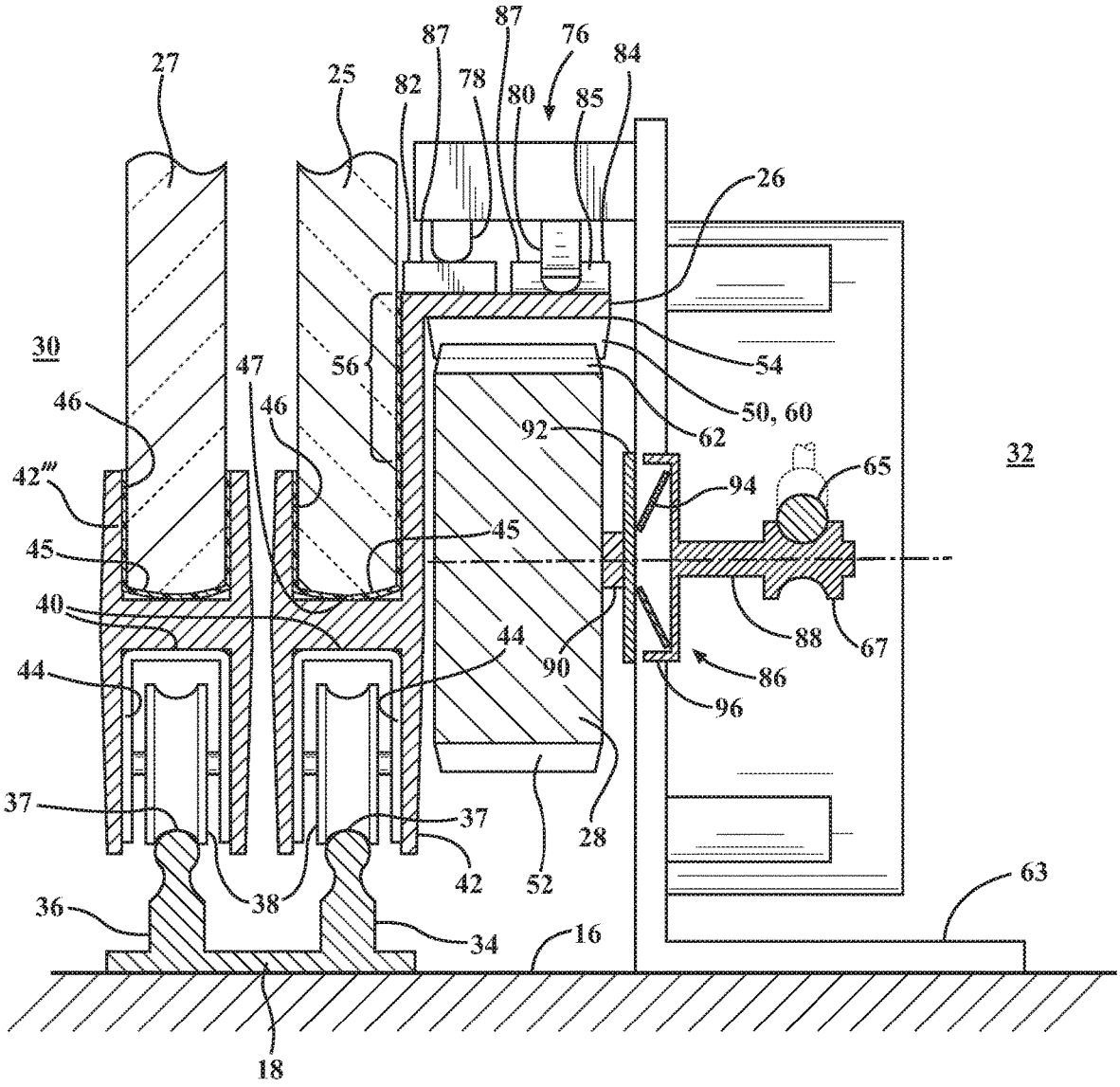
FIG. 1B is a cross-sectional view taken generally along the line 1B-1B of FIG. 1.
Figure 2:
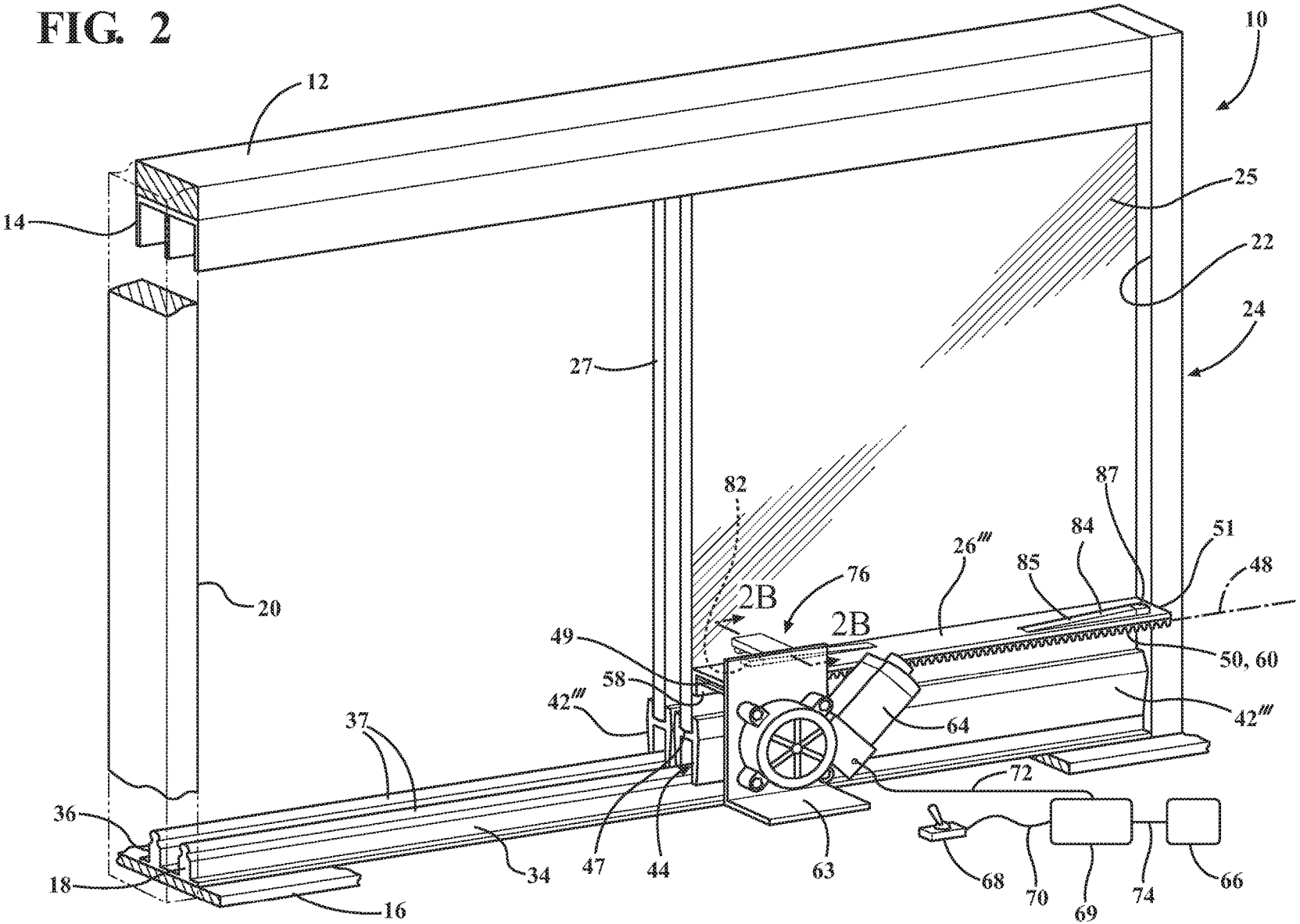
FIG. 2 is a perspective view of an actuatable slidable panel assembly in accordance with another aspect of the invention.

The lower guide track 18, sometimes referred to as a "shoe rail" by those skilled in the art of sliding windows, as best shown in FIGS. 1, 1A and 2, has at least one and shown as having a pair of upstanding guide rails 34, 36. The guide rails 34, 36 extend generally parallel to one another in laterally spaced relation with one another sufficiently to allow the slidable panel 25 to slide past the other panel 27, which as mentioned above, can also be provided as a slidable panel. The guide rails 34, 36 have a cross-sectional profile, shown as being generally balloon-shaped or bulbous in form, having a rounded upper free end 37, configured to facilitate rolling movement of wheels, also referred to as rollers 38, therealong.

The rollers 38 are supported for rolling movement about axles that are fixed within roller support housings 40. The roller support housings 40 are configured for attachment to a panel support member 42, sometimes referred to as a "shoe" by those skilled in the art of sliding windows. The panel support member 42 can be generally H-shaped, or have a generally H-shaped portion, as viewed in lateral cross-section, thereby providing a lower, generally U-shaped slide channel 44, configured for snug, sometimes referred to as "interference fit", or snapping receipt of the roller support housings 40 therein, and an upper, generally U-shaped panel receptacle, also referred to as fixation channel 46, configured for snug, fixed receipt of a free edge 47 of the panels 25, 27 therein. To facilitate providing a snug fit of the free edge 47 in the fixation channel 46, oftentimes a gasket member 45 is provided, wherein the gasket member 45 allows for slight variances in window or panel thickness, and also facilitates removal of the free edge 47 of the panel from the fixation channel 46, when desired. The rollers 38 are provided having a concave peripheral contour to mate with the convex, rounded free end 37 of the guide rails 34, 36 so that the rollers 38 remain "on track" and engaged for rolling movement along the guide rails 34, 36.

Figure 2A:
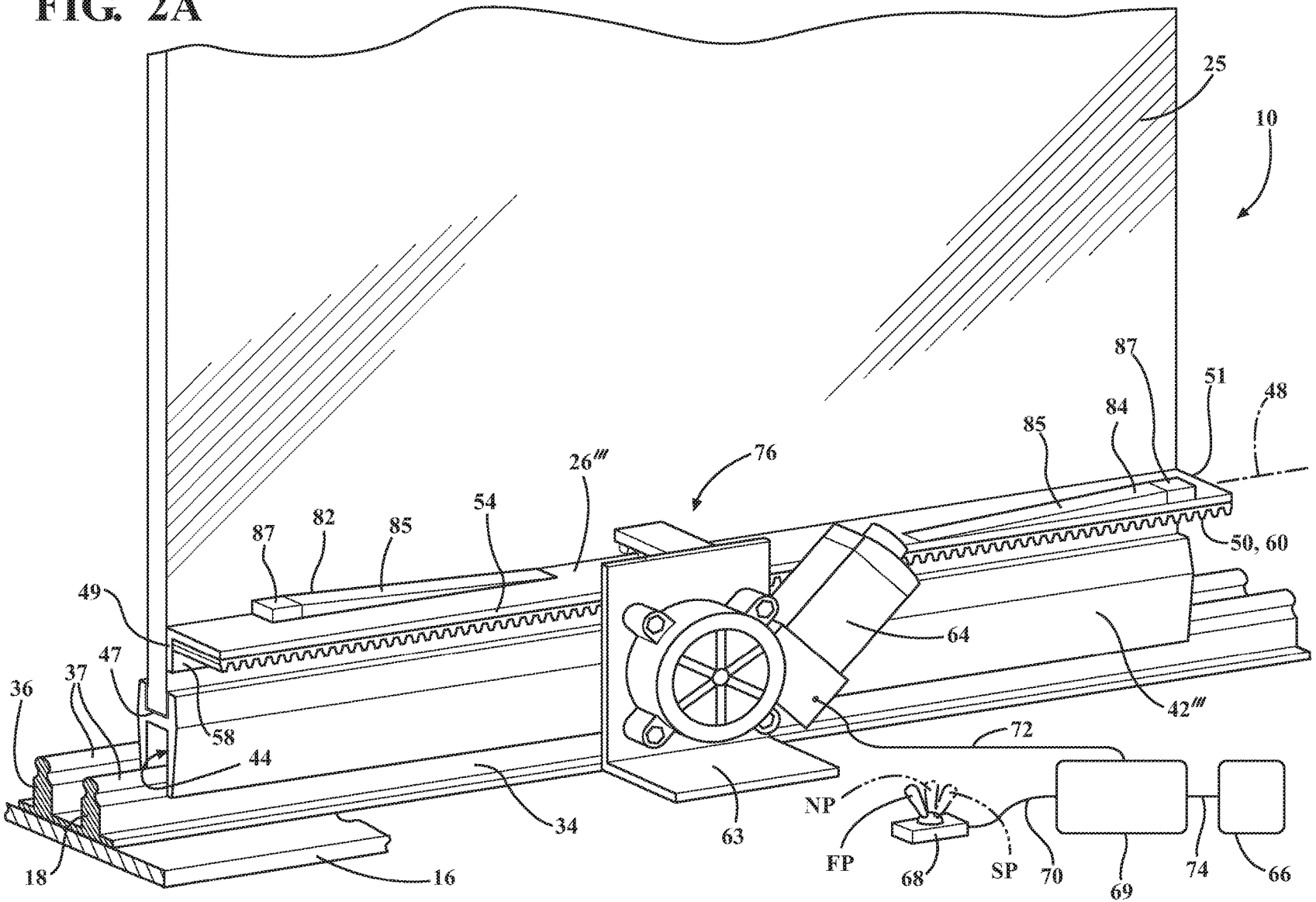
FIG. 2A is an enlarged fragmentary view of a lower region of the assembly of FIG. 2.
Figure 2B:
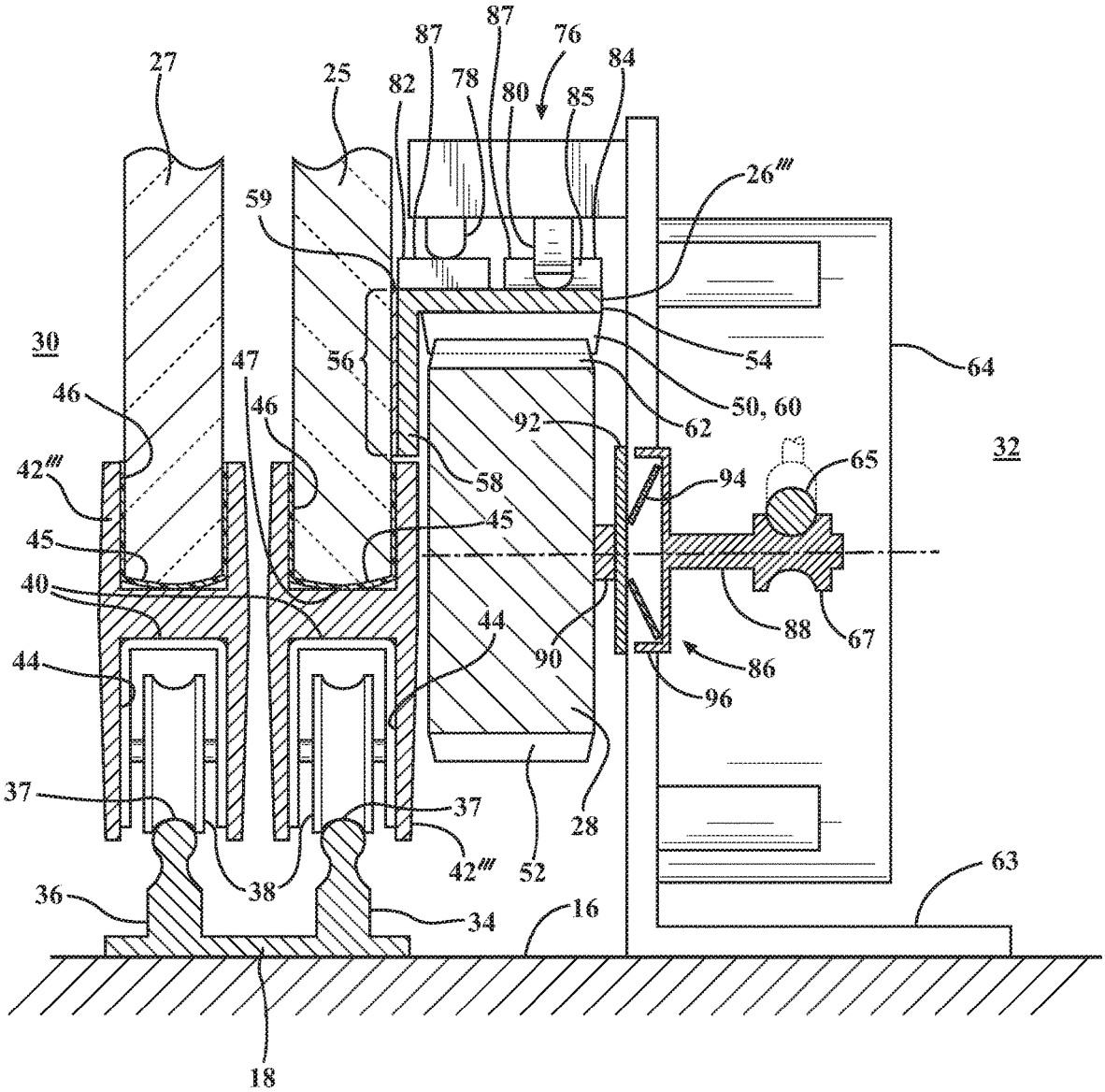
FIG. 2B is a cross-sectional view taken generally along the line 2B-2B of FIG. 2.
Figure 3A:
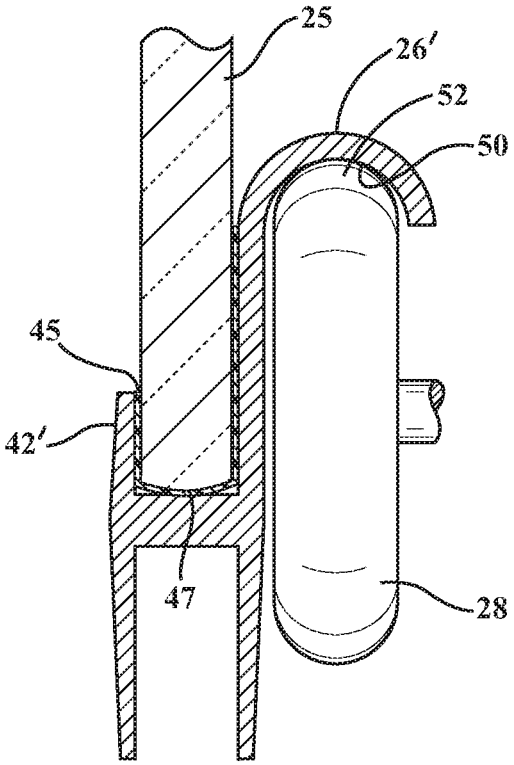
FIG. 3A is a cross-sectional view showing a portion of an actuatable slidable panel assembly configured in accordance with another aspect of the invention.
Figure 3B:
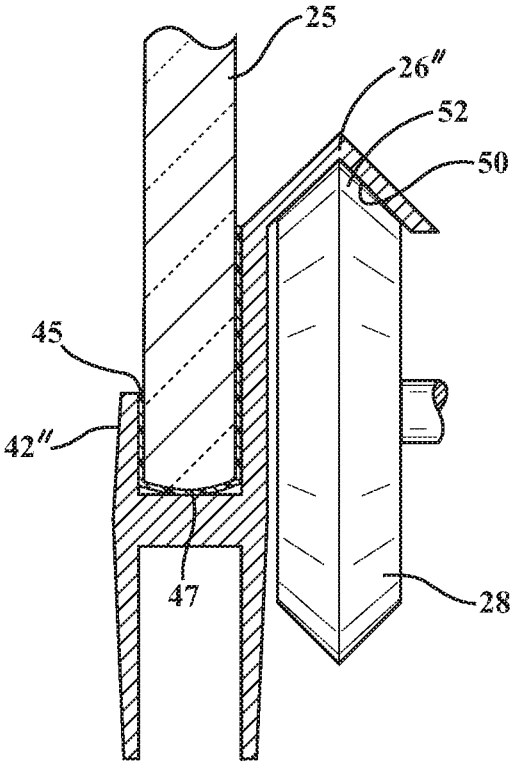
FIG. 3B is a view similar to FIG. 3A showing a portion of an actuatable slidable panel assembly configured in accordance with another aspect of the invention.

The driven rail 26 extends along a longitudinal axis 48 between opposite ends 49, 51, with the longitudinal axis 48 extending substantially parallel to a direction of travel of the slidable panel 25 as it moves between open and closed positions. The driven rail 26 can be provided as a monolithic piece of material (formed of a single piece of material, such as in an extrusion process, by way of example and without limitation) with the panel support member 42, as shown in FIGS. 1, 1A, 1B, 3A, and 3B, wherein FIGS. 3A and 3B illustrate examples of alternate embodiments of the driven rail and associated driven rail 42', 26'; 42", 26", or the driven rail 26'" can be formed as a separate piece of material from the panel support member 42", as shown in FIGS. 2, 2A, and 2B and discussed in more detail below. Regardless of how constructed, the driven rail 26, 26', 26", 26'" has a driven surface 50 configured to be selectively driven via a drive surface 52 (FIGS. 1B and 2B) of the drive member 28. The driven surface 50 is shown formed on a leg 54 of an L-shaped region 56 of the driven rail 26, 26'" that extends laterally and obliquely outwardly from the slidable panel 25, and shown, by way of example and without limitation, as extending in generally transverse relation therefrom. In the embodiments of FIGS. 3A and 3B, the leg 54 is shown having respective arcuate regions 56 providing concave driven surfaces 50, with the driven surface 50 of FIG. 3A having a generally smooth circular radius and the driven surface 50 of FIG. 3B having a generally V-shaped surface, with both being configured for mating contact with similarly shaped drive surfaces 52. Another leg 58 of the L-shaped or region 56 extends generally parallel to a plane of the slidable panel 25 for abutment with slidable panel 25, and in the case of the driven rail 26", the leg 58 is configured for fixed attachment to the slidable panel 25, such as via an adhesive 59 sufficient to permanently fix the leg 58 to the slidable panel 25, by way of example and without limitation. As shown, for the driven rail 26 that is formed as a monolithic piece of material with the panel support member 42, the driven rail 26 can be operably fixed to the slidable panel 25 via insertion of the slidable panel free edge 47 in the fixation channel 46 formed in the H-shaped region of the panel support member 42. As such, no additional fixing mechanism is needed, other than the fixation channel 46, to secure the driven rail 26 to the slidable panel 25. However, the aforementioned gasket 45 can be incorporated as desired. Further, the driven rail 26 is automatically located for operable engagement with the drive member 28 upon the one-piece panel support member 42/driven rail 26 being attached to the slidable panel 25, thereby making assembly easy and economical.

The driven surface 50 can be provided via any suitable high friction/traction surface such that the drive member 28 causes substantial conjoint movement of the driven rail 26, 26', and in one preferred embodiment the driven surface 50 is provided via a plurality of driven teeth 60 configured for meshed engagement with a plurality of drive teeth 62 on the drive member 28. The driven teeth 60 can be formed within the material of the driven rail 26, 26' or via attachment of another material to the leg 54 of the driven rail 26, 26'. In one presently preferred embodiment, the driven teeth 60 are provided via a flat, planar polymeric strip of material having teeth formed therein, such as typically found on a timing belt, as would be readily understood by one skilled in the art upon viewing the disclosure herein. Of course, the drive teeth 62 are provided to mesh with the driven teeth 60 to ensure minimal free motion, or play, sometimes referred to as slack, therebetween.

The drive member 28 is operably coupled to a motor 64 for rotation upon actuation of the motor 64. The motor 64 can be provided as any suitable electric motor, such as a stepper motor or otherwise, and in one presently preferred embodiment is provided as a motor having a thread worm 65 meshed for driving engagement with a corresponding worm gear 67, by way of example and without limitation. The motor 64 can be supported by a mount member 63, with the mount member 63 being configured for attachment to any desired surface, such a sill or ledge adjacent the panel assembly 24, via any suitable fastening mechanism, such as threaded fasteners, adhesives, or otherwise. It is to be recognized that the motor 64 and mount member 63 can be configured for use in any desired orientation relative to the panel assembly 24, and thus, the motor 64 and mount member 63 can be arranged for fixation adjacent either side of an opening established by the slidable panel 25. The motor 64 is operably connected to a power source 66, such as an AC or DC or rechargeable power source, by way of example without limitation, via a switch 68. The switch 68 is operable to cause the motor 64 and drive member 28 to rotate in a first direction upon moving the switch to a first position FP, thereby causing the slidable panel 25 to move toward an open position, and to rotate in a second direction opposite the first direction upon moving the switch 68 to a second position SP, thereby causing the slidable panel 25 to move toward a closed position. The switch 68 is further operable to interrupt power flow to the motor 64 upon moving the switch 68 to a neutral position NP, thereby ensuring the motor 64 remains in a de-energized state.

In the embodiment illustrated, the switch 68 is operably connected to a control board, such as on a printed circuit board (PCB) 69. The operable connection can be via a wireless or hardwire connection 70. It is to be recognized that the switch 68 could be mounted integrally with and directly on the PCB 69, if desired. The PCB 69 is shown as being operably connected in electrical communication with the motor 64 and to the power source 66 via respective wireless or hardwire connections 72, 74.

The PCB 69 is programmable, and in one presently preferred embodiment, is configured in electrical communication with a sensor system shown generally at 76. The sensor system 76 includes at least one, and shown as a plurality of sensors 78, 80 configured for operable engagement with respective actuators 82, 84. The sensors 78, 80 can be provided as any suitable sensor that is operable as a switch to selectively interrupt the flow of power upon being deployed/actuated to a predetermined extent. In the example illustrated, the sensors 78, 80 work in conjunction with their respective actuators 82, 84 to move between actuated and de-actuated states. In one embodiment, the actuators 82, 84 are shown as inclined ramps, by way of example and without limitation, and as the respective sensor 78, 80 traverses upwardly along an inclined surface 85 of the respective actuator 82, 84, and when the slidable panel 25 reaches its final desired open or closed position, the respective sensor 78, 80 rides up onto and along a flattened plateau 87 of the respective actuator 82, 84 and becomes actuated, thereby triggering a response to interrupt the flow of electrical power to the motor 64. Accordingly, although the switch 68 can remain in the selected first or second positions FP, SP, the power to the motor 64 is interrupted as a result of the respective sensor 78, 80 being actuated, thus, causing the slidable panel 25 to cease movement and remain in the desired position (opened or closed). In addition to the sensors 78, 80 being responsible for communicating with the PCB 69 to selectively interrupt the flow of electrical power to the motor 64, and conversely, to selectively establish the flow of electrical power to the motor 64, the sensors 78, 80, with the sensors 78, 80 being cantilevered laterally from the mount member 63 and located above the driven rail 26, in contact therewith, the sensors 78, 80 prevent the driven rail 26 from being inadvertently moved upwardly out of operable driven engagement with the drive member 28. As such, the driven surface 50 of the driven rail 26 is assured of remaining in its proper engagement with the drive surface 52 of the drive member 28.

To facilitate the desired movement, and interruption of movement, of the slidable panel 25, a clutch assembly 86 can be incorporated operably between an output shaft 88 of the motor 64 and the drive member 28. The clutch assembly 86 is preferably selectively adjustable to allow the amount of torque applied by the output shaft 88 to an input shaft 90 of the drive member 28 to be precisely controlled. In one embodiment, the clutch assembly 86 is shown having an adjustment member, such as an internally female threaded nut 92, that is threaded onto a fixed extension of the input shaft 90 for operably engagement with a spring member, such as a Bellville type spring washer 94. The spring washer 94 is in turn configured in operable engagement with a clutch housing 96 that is fixed for conjoint rotation with the output shaft 88 of the motor 64, which is illustrated as being fixed to the driven worm gear 67. As such, as the adjustment member 92 is selectively adjusted in one of a tightening or loosening direction, the torque applied by the output shaft 88 to the input shaft 90 is precisely varied and controlled. Accordingly, as the adjustment member 92 is tightened, the spring washer 94 becomes increasingly axially compressed against the clutch housing 96 and radially compressed against the input shaft 90, thereby increasing the amount of torque that can be transferred therebetween. To the contrary, as the adjustment member 92 is loosened, the spring washer 94 becomes increasingly axially expanded, thereby reducing the compression force of the spring washer 94 against the clutch housing 96 and the input shaft 90, and thus, decreasing the amount of torque that can be transferred therebetween. It is contemplated that the torque applied to the input shaft 90 will be sufficient to move the slidable panel 25 between the opened and closed positions; however, it is further contemplated that the torque can be low enough to avoid causing harm to anything that may come in the path of the slidable panel 25 as it is moving, such as between about 1-5 ft-lb of torque, by way of example and without limitation. In a case where something obstructs movement of the slidable panel 25, the clutch assembly 86 will allow the output shaft 88 to rotate freely relative to the stationary input shaft 90. It is to be recognized that the motor 64 and clutch assembly 86 can be provided to allow sufficient torque to move the desired slidable panel assembly, depending on the application.

In operation, when the slidable panel 25 is desired to be moved, the switch 68 can be selectively moved to the appropriate position, whether the first position FP to open the slidable panel 25 or the second position SP to close the slidable panel 25, depending on the direction of movement desired. For example, if the slidable panel 25 is in a closed position, while the switch 68 is in the second position SP, the switch 68 can simply be moved to the first position FP to cause the slidable panel 25 to move toward the open position. The slidable panel 25 continues to move toward the open position either until the sensor 78 is actuated by the actuator 82 or until the switch 68 is moved to either the neutral position NP or back to the second position SP. If the switch 68 is left in the first position FP, the slidable panel 25 moves fully to the open position, at which time the sensor 78 is actuated by the actuator 82. Upon the sensor 78 being actuated, the actuated sensor 78 breaks the electrical circuit to interrupt the flow of power to the motor 64. With the slidable panel 25 being in the fully open position, the switch 68 can remain in the first position FP given the power flow to the motor 64 is interrupted.

On the other hand, if the slidable panel 25 is in an open position, while the switch 68 is in the first position FP, the switch 68 can simply be moved to the second position SP to cause the slidable panel 25 to move toward the closed position. The slidable panel 25 continues to move toward the closed position either until the sensor 80 is actuated by the actuator 84 or until the switch 68 is moved to either the neutral position NP or back to the first position FP. If the switch 68 is left in the second position SP, the slidable panel 25 moves toward the closed position until the sensor 80 is actuated by the actuator 84 and the panel 25 is fully closed. Of course, during movement of the slidable panel 25 toward the closed position, movement of the slidable panel 68 may be interrupted by an object, such as a person's arm or otherwise, and in this case, the clutch assembly 86 allows the slidable panel 25 to stop in abutment with the person's arm while the motor 64 continues to run. Given the relatively low toque being transferred through the slip-clutch assembly 86, no harm may be caused to the person or object interfering with the movement of the slidable panel 25. Then, once the person's arm or object is removed from the path of the slidable panel 25, the slidable panel 25 automatically continues to move toward the closed position. Then, upon the slidable panel 25 reaching the fully closed position and the sensor 80 being actuated by the actuator 84, the sensor 80 breaks the electrical circuit to interrupt the flow of power to the motor 64. With the slidable panel 25 being in the fully closed position, the switch 68 can remain in the second position SP given the power flow to the motor 64 is interrupted. Then, if a person manually moves the slidable panel 25 away from the fully closed position toward the open position with the switch 68 in the second position SP, the sensor 80 becomes de-actuated, as it moves away downwardly along the ramped surface of the actuator 84, thereby re-established the electrical circuit and restoring power flow to the motor 64. As long as the person is applying a sufficient force to the slidable panel 25, the slip-clutch assembly 86 allows the motor 64 to run and the output shaft 88 to rotate, while allowing the drive member 28 and input shaft 90 to remain substantially stationary. Then, upon the person releasing the bias force from the slidable panel 25, the slidable panel 25 automatically returns back toward the closed position until the sensor 80 is again actuated by the actuator 84 to again break the electrical circuit and cease the flow of power to the motor 64. Accordingly, the slidable panel 25, unless manually over powered, is assured of remaining in the desired closed position without worry that it may be left in an unwanted open or slightly opened position. Thus, the desired privacy, in compliance with HIPAA laws, is assured across opposite sides of the slidable panel 25.

As discussed above, given the relatively low torque applied by the clutch assembly 86, a manually applied force can readily overcome the bias imparted thereby. As such, when desired, such as during a power outage or other power interruption, such as a blown fuse or tripped circuit breaker, by way of example and without limitation, the slidable panel 25 can be manually moved between the opened and closed positions, as desired.

In view of the above disclosure and in view of the Figures, one possessing ordinary skill in the art will readily appreciate the many benefits provided by the selectively actuatable, selectively automated movement of the slidable panel 25, including, for example, assuring the panel 25 is automatically biased to the desired position, whether opened or closed, and further, being able to simply actuate movement of the panel 25 to the desired opened or closed position via a switch 68. It will be further appreciated that the burden placed on a person having to repeatedly open and close the slidable panel 25 is non-existent, other than having to move the switch 68 to the desired position. Accordingly, the repetitive motion typically required by a person to move the slidable panel 25 between opened and closed positions, including shoulder and arm movement, is done away with, thereby avoiding potential injury to the person, sometimes referred to as repetitive motion injury. What will be further appreciated is that the apparatus discussed above, including all features other than the original manually operated panel assembly 24 itself, namely, the driven rail 26, 26', 26", 26", the motor 64 and clutch assembly 68, the switch 68, the PCB 69, can be provided in an all-inclusive kit to readily and easily retrofit an existing manually operated panel assembly 24 to be automated for movement between opened and closed positions, as discussed above. It will be further recognized that the kit can include the desired type of driven rail, whether a separate driven rail 26' from the panel support member 42", wherein a new panel support member 42'" could be provided or an already existing panel support member 42'" on the slidable panel 25 being retrofitted could be used, or as an integral, single piece of material with a panel support member 42, 42', 42" (monolithic component), as discussed and shown for the driven rails 26, 26', 26". If provided as a single piece member 26, 42; 26', 42'; 26", 42", the existing panel support member 42'" can be simply removed from the slidable panel 25 of the existing panel assembly 24 and replaced with the new monolithic driven rail and panel support member combination 26, 42; 26', 42'; 26", 42". By providing all the needed components for retrofitting a manual panel assembly 24 for automated actuation in a kit, the conversion is simplified and the installer is assured of having all the proper components for making the conversion. Of course, it should be further recognized that an actuatable slidable panel assembly 10 including all the features discussed above to provide the slidable panel 25 as being mechanically actuatable is contemplated herein. Accordingly, aside from providing the retrofit kit discussed above, a original equipment manufacturer (OEM) could provide an actuatable slidable panel assembly 10 or panel assembly 24 therefor, including the aforementioned features for automated, mechanically assisted slidable panel 25 movement.

In accordance with retrofitting an existing, manually operated panel assembly 24 for automated actuation, a method of retrofitting a slidable panel 25 of the panel assembly 24 for mechanically assisted, actuatable sliding movement includes, fixing an elongate driven rail 26, 26', 26", 26'" to the slidable panel 25 with the elongate driven rail 26, 26', 26", 26'" extending substantially parallel to a direction of travel of the slidable panel 25. As discussed above, the addition of the driven rail to the assembly 24 can include fixing the driven rail 26'" as a separate member from the existing shoe 42'" to the slidable panel 25, or as a monolithic piece 26, 26', 26" with a new integrated shoe 42, 42', 42" to the slidable panel 25. Further, fixing a rotatable drive member 28 in operable engagement with the elongate driven rail 26, 26', 26", 26'" and operably coupling a motor 64 to the rotatable drive member 28, and configuring the motor 64 for selective actuation to rotate the rotatable drive member 28 in opposite directions to drive the panel 25 between open and closed positions.

The method can further include providing the elongate driven rail 26, 26', 26", 26'" with a plurality of driven teeth 60 and providing the rotatable drive member 28 with a plurality of drive teeth 62 and arranging the drive teeth 62 in meshed, driving engagement with the driven teeth 60.

The method can further include providing the elongate driven rail 26, 26', 26" having an H-shaped region, as viewed in cross-section, with a fixation channel 46 being formed on one side of the H-shaped region and a slide channel 44 being formed on an opposite side of the H-shaped region, and fixing a free edge 47 of the slidable panel 25 in the fixation channel 46 and arranging the slide channel 44 for sliding movement along a guide track 18 of the slidable panel 25. In this embodiment, the old existing shoe 42'" can be simply removed from the slidable panel 25 by pulling or sliding the existing shoe 42'" off the free edge 47 of the slidable panel 25 and the new shoe 42, 42', 42", including the respective integral driven rail 26, 26', 26" (FIGS. 1-1B, 3A-3B), can be simply attached to the slidable panel 25. With the driven rail 26, 26', 26" being formed as monolithic piece of material with the shoe 42, 42', 42", assembly is simplified by simply being able to operably fix the driven rail 26, 26', 26" to the slidable panel 25 via inserting the free edge 47 of the slidable panel 25 into the fixation channel 46, with an optional gasket 45 being used to facilitate a snug fit. Accordingly, no additional adhesives or fixing mechanisms are needed to attach the driven rail 26, 26', 26" to the slidable panel 25 other than inserting the free edge 47 of the slidable panel 25 into the fixation channel 46 of the shoe 42, 42', 42".

The method can further include providing a plurality of rollers 38 fixed in the slide channel 44 and arranging the plurality of rollers 38 to roll along a guide rail 34 of the guide track 18.

The method can further include providing a slip-clutch 86 between the motor 64 and the rotatable drive member 28, with the slip-clutch 86 being adjustable to regulate the torque transmitted between the rotatable drive member 28 and the driven rail 26, 26', 26", 26'".

The method can further include providing the elongate driven rail 26'" having first and second legs 54, 58 being generally L-shaped as viewed in cross-section, and attaching the first leg 58 to the slidable panel 25 and arranging a driven surface 50 of the second leg 54 in engagement with the rotatable drive member 28.

The method can further include providing the kit so that the slidable panel 25 can be driven from either of its opposite sides. Thus, it is to be recognized that the motor 64 can be configured to be mounted adjacent either side of the slidable panel 25, as will be readily recognized by one skilled in the art.

It is to be understood that other embodiments of the invention which accomplish the same function are incorporated herein within the scope of any ultimately allowed patent claims.

What is claimed is:

1. An actuatable slidable panel assembly, comprising:

a guide track;

a panel slidable along said guide track between open and closed positions;

an elongate driven rail attached to said panel, said elongate driven rail extending along a longitudinal axis between opposite ends, with said longitudinal axis extending substantially parallel to a direction of travel of said panel;

a rotatable drive member configured for operable engagement with said elongate driven rail to drive said panel along said guide track between open and closed positions;

said elongate driven rail having a fixation channel extending along said longitudinal axis, said panel having a free edge fixed in said fixation channel;

said elongate driven rail having an H-shaped region as viewed in cross-section, said fixation channel being on one side of said H-shaped region and a slide channel being on an opposite side of said H-shaped region, said slide channel facilitating sliding movement of said panel along the direction of travel; and said elongate driven rail having a driven surface that extends in inclined relation from an upstanding leg of said H-shaped region in cantilevered, overlying relation with said rotatable drive member.

2. The actuatable slidable panel assembly of claim 1, wherein said driven surface of said elongate driven rail has a plurality of driven teeth and said rotatable drive member has a plurality of drive teeth, said drive teeth being configured in meshed, driving engagement with said driven teeth.

3. The actuatable slidable panel assembly of claim 1, wherein said driven surface of said elongate driven rail extends laterally outwardly in oblique relation from the upstanding leg of said H-shaped region.

4. The actuatable slidable panel assembly of claim 1, further including a motor operably attached to said rotatable drive member, said motor being selectively actuatable to rotate said rotatable drive member in opposite directions.

5. The actuatable slidable panel assembly of claim 4, further including a slip-clutch between said motor and said rotatable drive member, said slip-clutch being adjustable to regulate the torque transmitted between said rotational drive member and said driven rail.

6. The actuatable slidable panel assembly of claim 1, wherein said driven surface and said H-shaped region are formed as a monolithic piece of material.

7. A kit for mechanically assisting movement of a slidable panel of a panel assembly between open and closed positions, comprising:

an elongate driven rail configured for attachment to the slidable panel, said elongate driven rail extending along a longitudinal axis between opposite ends, with said longitudinal axis extending substantially parallel to a direction of travel of said slidable panel upon being attached to said slidable panel, said elongate driven rail having an H-shaped region as viewed in cross-section, a fixation channel being formed on one side of said H-shaped region, said fixation channel being configured to receive a free edge of said slidable panel therein, and a slide channel being formed on an opposite side of said H-shaped region, said slide channel being configured to facilitate sliding movement of said slidable panel along the direction of travel, said elongate driven rail having a driven surface extending laterally outwardly in cantilevered fashion from an upstanding leg of said H-shaped region;

a rotatable drive member configured to be disposed beneath said driven surface for operable engagement with said driven surface to drive said elongate driven rail and said slidable panel along the direction of travel between open and closed positions;

a motor operably attached to said rotatable drive member, said motor being selectively actuatable to rotate said rotatable drive member in opposite directions to drive said slidable panel along the direction of travel between open and closed positions; and a clutch assembly operably connecting an output shaft of said motor to said drive member, said clutch assembly being selectively adjustable to regulate the torque applied by said output shaft to said drive member.

8. The kit of claim 7, further including providing said driven surface of said elongate driven rail having a plurality of driven teeth extending lengthwise in laterally outward, transverse relation from an upstanding leg of said H-shaped region.

9. The kit of claim 7, further including providing said driven surface and said H-shaped region being formed as a monolithic piece of material.

10. A method of retrofitting a slidable panel of a panel assembly having a manually actuated sliding movement to mechanically assisted, actuatable sliding movement, comprising:

fixing an elongate driven rail to the slidable panel with said elongate driven rail extending substantially parallel to a direction of travel of the slidable panel, said elongate driven rail having an H-shaped region as viewed in cross-section with a fixation channel being on one side of the H-shaped region, with the slidable panel being fixed in the fixation channel, and a slide channel being on an opposite side of the H-shaped region, said elongate driven rail having a driven surface cantilevered laterally outwardly from an upstanding leg of the H-shaped region, the driven surface being formed as a monolithic piece of material with the H-shaped region; and disposing a rotatable drive member beneath the driven surface in operable engagement with the driven surface of the elongate driven rail; and operably coupling a motor to the rotatable drive member and configuring the motor for selective actuation to rotate the rotatable drive member in opposite directions to drive the slidable panel between open and closed positions.

11. The method of claim 10, further including providing the driven surface of the elongate driven rail with a plurality of driven teeth and providing the rotatable drive member with a plurality of drive teeth and arranging the drive teeth in meshed, driving engagement with the driven teeth.

* * * * *